US008353518B1

(12) United States Patent
Lai et al.

(10) Patent No.: US 8,353,518 B1
(45) Date of Patent: Jan. 15, 2013

(54) GAME MACHINE

(75) Inventors: Poszu Lai, Changhua (TW); I-Chiang Yang, Changhua County (TW); Tsair-Rong Chen, Changhua County (TW); Wen-Ren Yang, Taipei (TW)

(73) Assignees: Peiloli Electronic Co., Ltd., Hemei Town, Changhua County (TW); Department of Electrical Engineering, National Changhua University of Education, Changhua (TW)

( * ) Notice: Subject to any disclaimer, the term of this patent is extended or adjusted under 35 U.S.C. 154(b) by 0 days.

(21) Appl. No.: 13/330,656

(22) Filed: Dec. 19, 2011

(51) Int. Cl.
*A63F 7/36* (2006.01)

(52) U.S. Cl. ..... 273/447

(58) Field of Classification Search ..... 273/447, 273/448; 312/114, 223.1, 352
See application file for complete search history.

(56) References Cited

U.S. PATENT DOCUMENTS

| | | | | |
|---|---|---|---|---|
| 7,635,131 | B2 * | 12/2009 | Fukazawa et al. | 273/447 |
| 8,079,596 | B1 * | 12/2011 | Shoemaker, Jr. | 273/447 |
| 2005/0218602 | A1 * | 10/2005 | Watanabe et al. | 273/447 |
| 2007/0029734 | A1 * | 2/2007 | Fukazawa et al. | 273/447 |

* cited by examiner

*Primary Examiner* — Raleigh W Chiu

(57) ABSTRACT

A game machine includes a main frame standing on a supporting surface, a 3D catcher mounted in a top portion of the main frame, an operational unit mounted onto the main frame for controlling the 3D catcher and a gate assembly mounted in a lower portion of the main frame, through the gate assembly, the operator can take the falling prize.

1 Claim, 4 Drawing Sheets

GAME MACHINE

BACKGROUND OF THE INVENTION

1. Field of the Invention

The present invention relates to a game machine, and more particularly to a game machine that has an anti-theft function.

2. Description of Related Art

A conventional game machine includes a main frame, a 3D catcher and an operational unit mounted onto the main frame for controlling the 3D catcher to catch a prize in the main frame. The main frame includes a panel for mounting the operational unit and a window defined in a lower portion of the panel. The main frame includes a partition horizontally mounted in the main frame for supporting the prizes and a dispensing hole defined in the partition. A dispensing tube is connected to an underside of the partition and communicates with the dispensing hole for guiding the falling prize to a place corresponding to the window such that the operator can take the prize through the window.

However, the conventional game machine has no anti-theft function structure such that the unworthy player may steal the prize on the partition by passing a hook structure through the dispensing tube. The loss is unnecessary to the game machine manager.

The present invention has arisen to mitigate and/or obviate the disadvantages of the conventional game machine.

SUMMARY OF THE INVENTION

The main objective of the present invention is to provide an improved game machine that has an anti-theft function.

To achieve the objective, the game machine in accordance with the present invention comprises a main frame standing on a supporting surface, a 3D catcher mounted in a top portion of the main frame, an operational unit mounted onto the main frame for controlling the 3D catcher to catch a prize and a gate assembly mounted in a lower portion of the main frame, through the gate assembly, the operator can take the falling prize. The main frame includes a partition horizontally positioned therein for supporting prizes and a dispensing hole defined in the partition. A dispensing tube is connected to an underside of the partition and communicates with the dispensing hole for guiding the falling prize to a place corresponding to the gate assembly. The main frame includes a panel and the operational unit is mounted onto the panel, wherein a window is defined in the panel and corresponding to the gate assembly. The gate assembly includes a door having an upper edge pivotally connected to an interior of the panel for selectively closing the window, and two side plates longitudinally mounted to the interior of the panel, wherein the two side plates respectively correspond to two opposite sides of the door. A board includes two opposite sides respectively slidably mounted onto an upper side of a corresponding one of the two side plates for selectively closing the dispensing tube when the door is inwardly pushed. At least one linkage includes two opposite ends respectively pivotally connected to an inner side of the door and an underside of the board.

Further benefits and advantages of the present invention will become apparent after a careful reading of the detailed description with appropriate reference to the accompanying drawings.

DETAILED DESCRIPTION OF THE INVENTION

Figure 1:
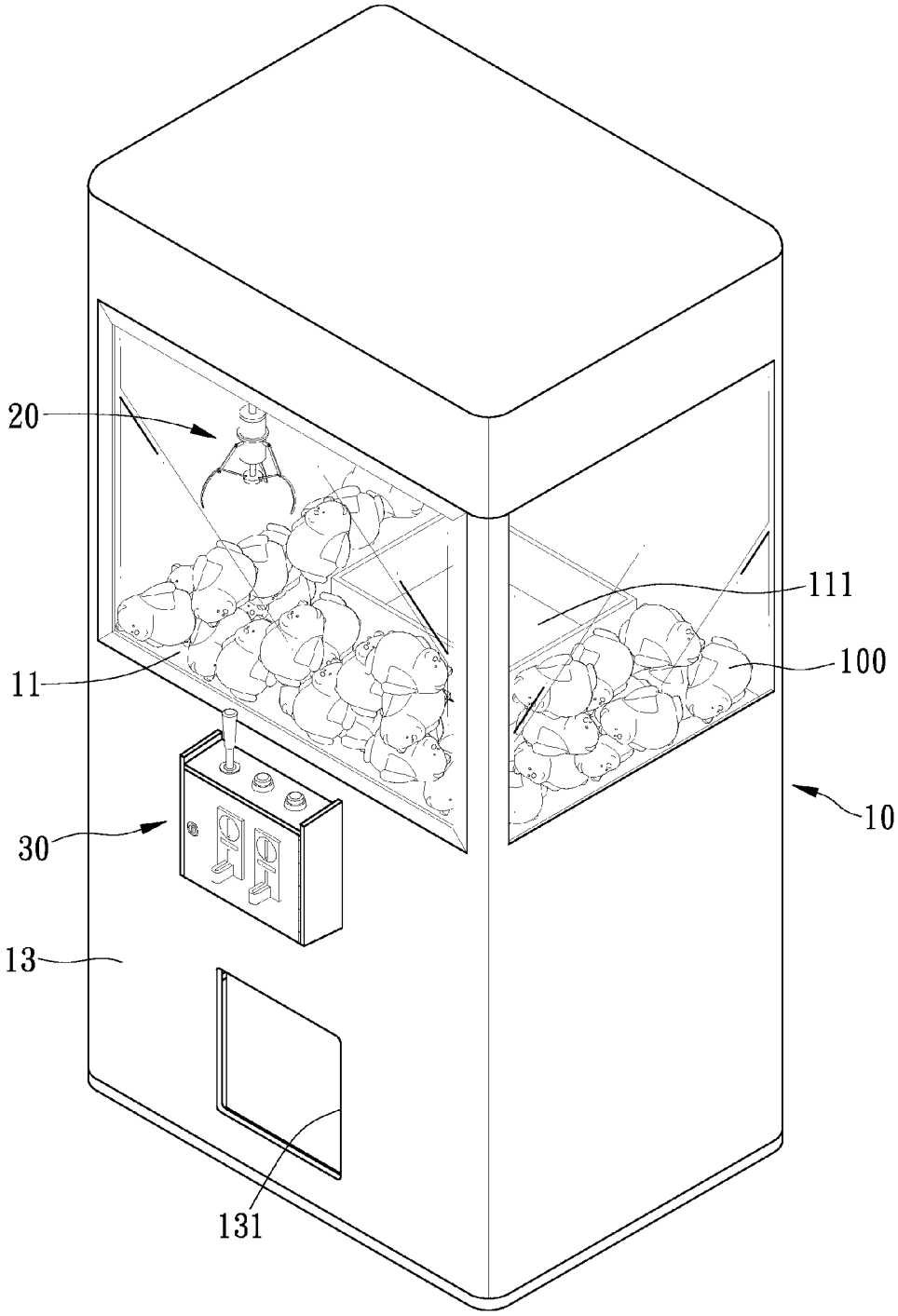
FIG. 1 is a perspective view of the game machine in accordance with the present invention.
Figure 4:
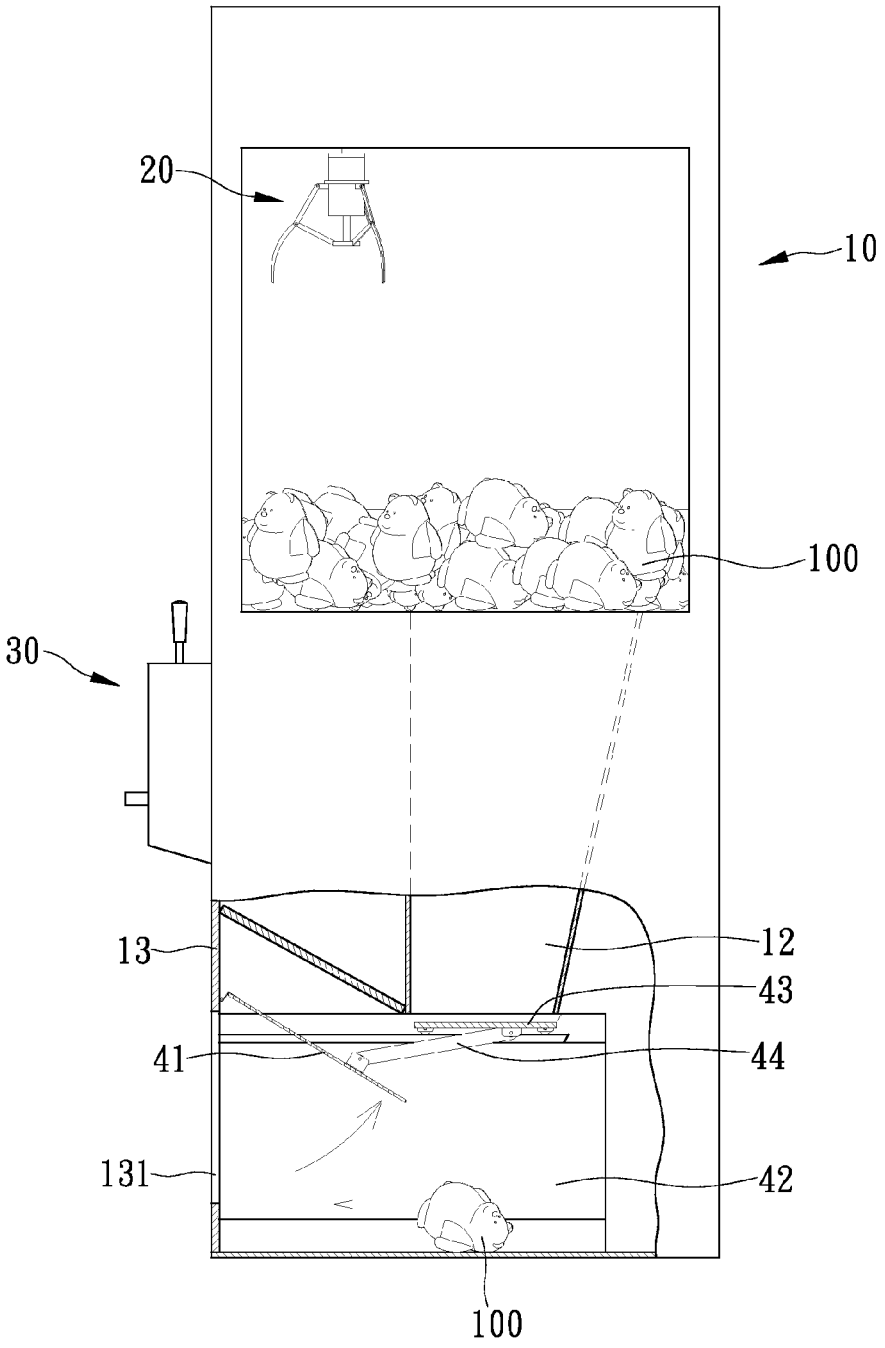
FIG. 4 is an operation view of the game machine in accordance with the present invention.

Referring to the drawings and initially to FIGS. 1 and 4, a game machine in accordance with the present invention comprises a main frame (10) standing on a supporting surface, a 3D catcher (20) mounted in a top portion of the main frame (10), an operational unit (30) mounted onto the main frame (10) for controlling the 3D catcher (20) and a gate assembly (40) mounted in a lower portion of the main frame (10), through the gate assembly (40), the operator can take the falling prize.

The main frame (10) includes a partition (11) horizontally positioned therein and a dispensing hole (111) is defined in the partition (11). A dispensing tube (12) is connected to an underside of the partition (11). The dispensing tube (12) communicates with the dispensing hole (111) for guiding the falling prize (100) to a place corresponding to the gate assembly (40). The main frame (10) includes a panel (13) and the operational unit (30) is mounted onto the panel (13). A window (131) is defined in the panel (13) and corresponds to the gate assembly (40). The window (131) is closed by the gate assembly (40) when the game machine is idle.

Figure 2:
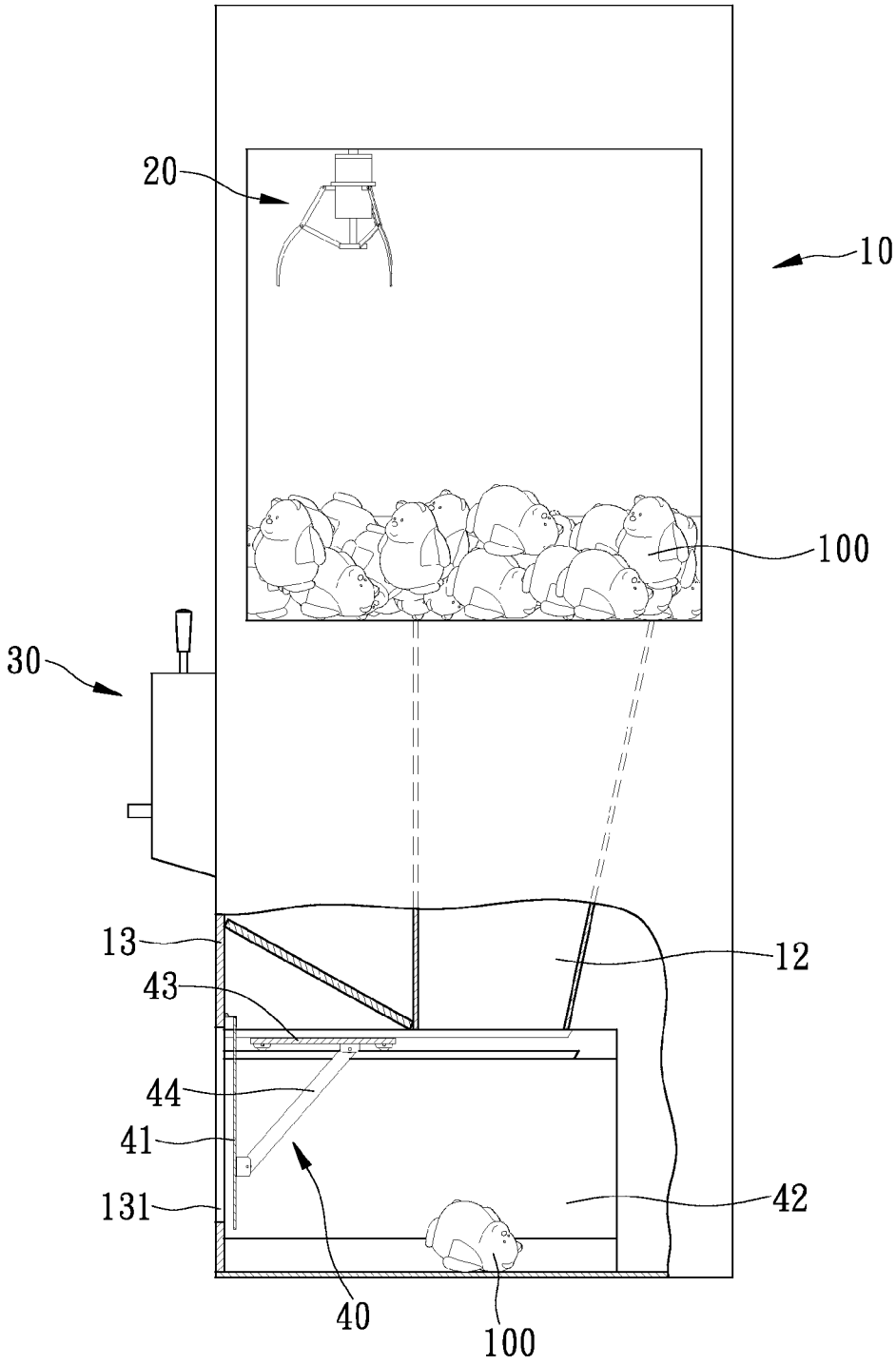
FIG. 2 is a side plan view in partial cross-section of the game machine in FIG. 1.
Figure 3:
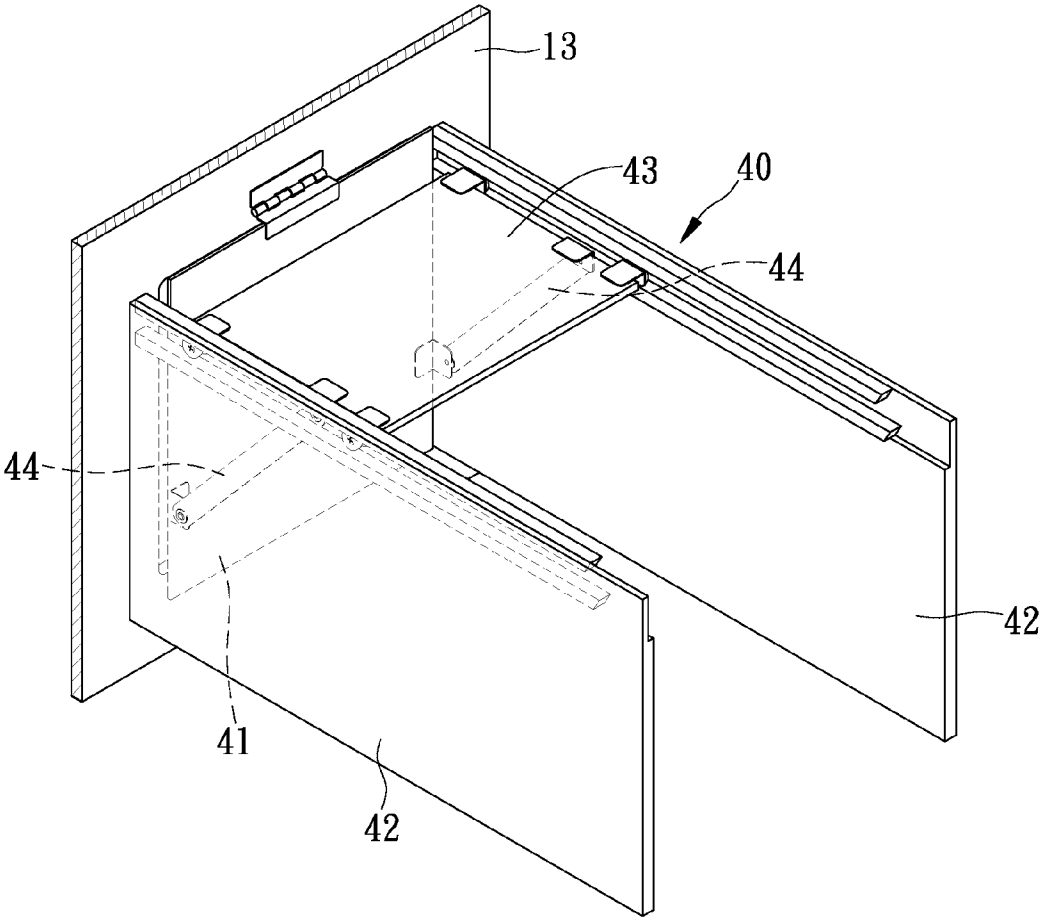
FIG. 3 is a perspective view of a gate assembly of the game machine in accordance with the present invention.

With reference to FIGS. 2 and 3, the gate assembly (40) includes a door (41) having an upper edge pivotally connected to an interior of the panel (13) for selectively closing the window (131), and two side plates (42) longitudinally mounted to the interior of the panel (13), wherein the two side plates (42) respectively correspond to two opposite sides of the door (41). A board (43) includes two opposite sides respectively slidably mounted onto an upper side of a corresponding one of the two side plates (42) for selectively closing the dispensing tube (12). At least one linkage (44) includes two opposite ends respectively pivotally connected to an inner side of the door and an underside of the board (43). For smoothly drive the board (43), in the preferred embodiment of the present invention, the gate assembly (40) includes two linkages (44) respectively pivotally connected to two opposite sides of the door (41) and the board (43).

With reference to FIGS. 1 and 2, the door (41) closes the window (131) due to the gravity thereof when the door (41) is idle and the board (43) is pulled and moved toward the panel (13) due to the linkage (44) such that the dispensing tube (12) is opened and the caught prize (100) can be fallen to the lower portion of the main frame (10) passing the dispensing tube (12). With reference to FIG. 4, when taking the fallen prize (100), the operator must inwardly push the door (41) through the window (131). At the same time, the board (43) is slidably moved on the two side plates (425) to close the dispensing tube (12).

Consequently, the unworthy player can not steal the prizes (100) on the partition (11) via the dispensing tube (12) because the dispensing tube (12) is closed when the door (41) is opened. As a result, the connected door (41) and the board (43) can provide an anti-theft function to the game machine in accordance with the present invention.

Although the invention has been explained in relation to its preferred embodiment, it is to be understood that many other possible modifications and variations can be made without departing from the spirit and scope of the invention as hereinafter claimed.

What is claimed is:

1. A game machine comprising a main frame standing on a supporting surface, a 3D catcher mounted in a top portion of the main frame, an operational unit mounted onto the main frame for controlling the 3D catcher to catch a prize and a gate assembly mounted in a lower portion of the main frame, through the gate assembly, the operator can take the falling prize; wherein:

the main frame includes a partition horizontally positioned therein for supporting prizes and a dispensing hole defined in the partition, a dispensing tube connected to an underside of the partition and communicating with the dispensing hole for guiding the falling prize to a place corresponding to the gate assembly, the main frame including a panel and the operational unit mounted onto the panel, a window defined in the panel and corresponding to the gate assembly; and the gate assembly includes a door having an upper edge pivotally connected to an interior of the panel for selectively closing the window, and two side plates longitudinally mounted to the interior of the panel, wherein the two side plates respectively correspond to two opposite sides of the door, a board including two opposite sides respectively slidably mounted onto an upper side of a corresponding one of the two side plates for selectively closing the dispensing tube when the door is inwardly pushed, at least one linkage including two opposite ends respectively pivotally connected to an inner side of the door and an underside of the board.

* * * * *

UNITED STATES PATENT AND TRADEMARK OFFICE

CERTIFICATE OF CORRECTION

PATENT NO. : 8,353,518 B1
APPLICATION NO. : 13/330656
DATED : January 15, 2013
INVENTOR(S) : Poszu Lai et al.

It is certified that error appears in the above-identified patent and that said Letters Patent is hereby corrected as shown below:

On the Title page of the patent, item (73) the Assignee name "Peiloli Electronic Co., Ltd." should instead read as:

"Feiloli Electronic Co., Ltd."

Signed and Sealed this
Twenty-eighth Day of May, 2013

Teresa Stanek Rea
*Acting Director of the United States Patent and Trademark Office*